US006694876B2

(12) United States Patent
Kawamori

(10) Patent No.: US 6,694,876 B2
(45) Date of Patent: Feb. 24, 2004

(54) APPARATUS FOR CHANGING OPERATIONAL PLATE CYLINDERS DURING ROTARY PRESS OPERATION

(75) Inventor: Hideo Kawamori, Tokyo (JP)

(73) Assignee: Kabushiki Kaisha Tokyo Kikai Seisakusho (JP)

( * ) Notice: Subject to any disclaimer, the term of this patent is extended or adjusted under 35 U.S.C. 154(b) by 0 days.

(21) Appl. No.: 10/008,735

(22) Filed: Dec. 6, 2001

(65) Prior Publication Data

US 2002/0152905 A1 Oct. 24, 2002

(30) Foreign Application Priority Data

Apr. 24, 2001 (JP) ..... 2001-126463

(51) Int. Cl.[7] ..... B41F 5/16; B41F 7/02; B41F 33/00

(52) U.S. Cl. ..... 101/180; 101/484; 101/218

(58) Field of Search ..... 101/178, 179, 101/180, 181, 484

(56) References Cited

U.S. PATENT DOCUMENTS 3,139,025 A * 6/1964 Chambon ..... 101/92
4,240,346 A * 12/1980 Landis et al. ..... 101/139
5,617,788 A * 4/1997 Horiguchi et al. ..... 101/181
5,970,870 A * 10/1999 Shiba et al. ..... 101/137
6,354,214 B1 * 3/2002 Tokiwa ..... 101/484

FOREIGN PATENT DOCUMENTS

JP 389668 6/1938
JP 8207233 8/1996

* cited by examiner

*Primary Examiner*—Andrew H. Hirshfeld
*Assistant Examiner*—Hoai-An D. Nguyen
(74) *Attorney, Agent, or Firm*—Trexler, Bushnell, Giangiorgi, Blackstone & Marr, Ltd.

(57) ABSTRACT

An apparatus for changing operational plate cylinders during rotary press operation is provided. This apparatus is possible to substantially equalize an actual print count to a set print count before change of operational plate cylinders. This can eliminate waste to print undesired recording paper (paper loss) and lead to cost down. A rotary press includes at least two or more plate cylinders (P), drive means (13, 13') for driving the plate cylinders (P) and switching means (15) for selectively switching the plate cylinders (P) in a printable state and in an unprintable state. In the apparatus (1) for changing operational plate cylinders during rotary press operation, input console means (2) is at least available for designating (x) an earlier operational plate cylinder (FP) that is switched from the printable state to the unprintable state by the switching means (15) and a later operational plate cylinder (RP) that is switched from the unprintable state to the printable state by the switching means (15) among the two or more plate cylinders (P), and setting (y) a print count before change of operational plate cylinders.

10 Claims, 2 Drawing Sheets

APPARATUS FOR CHANGING OPERATIONAL PLATE CYLINDERS DURING ROTARY PRESS OPERATION

RELATED/PRIORITY APPLICATION

This application claims priority with respect to Japanese Application No. 2001-126463, filed Apr. 24, 2001.

BACKGROUND

The present invention relates to an apparatus for changing operational plate cylinders during rotary press operation in a rotary press. The rotary press includes at least two or more plate cylinders, drive means for driving the plate cylinders and switching means for selectively switching the plate cylinders in a printable state and in an unprintable state.

A rotary press is publicly known as to have switching means for selectively switching plate cylinders in a printable state and in an unprintable state as disclosed in the publication of JP 8-207233A entitled "Roll Rotary Press" (hereinafter referred to as the prior art).

In the above prior art, the rotary press comprises at least one paper feeder for feeding a web paper, printing units provided with a plurality of plate cylinders, and a folding unit for cutting and folding the web paper after printed. In such the arrangement, the printing units and the folding unit are driven from respective individual drive means.

The web paper drawn from the paper feeder is passed through the printing units for use in printing from now on, including one that contains a plate cylinder in an unprintable state, and is transported to the folding unit, followed by print operation running. After prints are completed for an appropriately set print count, the printing unit being in the unprintable state by halting the plate cylinder is activated and accelerated to have a match in terms of a print operation speed and phase of the rotary press during operation.

The plate cylinder of the printing unit in the unprintable state, of which plate surface is separated from the surface of the web paper, is switched into the printable state, of which plate surface is contacted with the surface of the web paper, to start printing. On the other hand, as for the printing units previously designated appropriately before printing among the printing units in operation, their plate cylinders are switched from the printable state to the unprintable state, decelerated and halted. As described above, the prior art shows a rotary press that can change images to be printed without halting the rotary press during operation.

The above prior art, however, has some subject matters that should be solved respectively. In the prior art, although, in order to change operational plate cylinders, the plate cylinder halted in the unprintable state is activated and accelerated so as to have a match to the operation print speed of the rotary press, a timing of activation is not shown at all. In the print operation, the print count is previously determined for each printing. Therefore, it is desired to perform a production with a necessary and minimum print count before change of print operational plate cylinders to minimize undesired recording paper (paper loss). In practice, however, a system is not established for changing print operational plate cylinders at timing appropriate for actual prints that are not less than a scheduled print count. Accordingly, it is intended to determine an actual print count slightly larger, resulting in a trend of elevating the undesired recording paper (paper loss), which leads to cost up.

SUMMARY

The present invention is intended to solve such the subject mattes at a stroke that involve the prior art. It is therefore an object of the present invention to provide an apparatus for changing operational plate cylinders during rotary press operation, which is possible to substantially equalize an actual print count to a set print count before change of operational plate cylinders. This can eliminate waste to print the undesired recording paper (paper loss) and lead to cost down.

To achieve the above object, the present invention provides an apparatus for changing operational plate cylinders during rotary press operation in a rotary press. The rotary press includes at least two or more plate cylinders, drive means for driving the plate cylinders and switching means for selectively switching the plate cylinders in a printable state and in an unprintable state. The apparatus comprises input console means available for designating an earlier operational plate cylinder that is switched from the printable state to the unprintable state by the switching means and a later operational plate cylinder that is switched from the unprintable state to the printable state by the switching means among the two or more plate cylinders, setting at least a print count before change of operational plate cylinders, and inputting a print operation command to the rotary press; drive control means for performing a normal control for controlling the drive means to rotate the plate cylinder with a match in terms of a reference rotational speed and phase, and performing a special control for controlling the drive means to accelerate the later operational plate cylinder in a halt state up to a rotational speed in coincident with the same rotational speed as that of another plate cylinder normally controlled; drive signal output means for providing the drive control means with a normal control signal indicative of executing the normal control and a special control signal indicative of executing the special control; print count management means for always checking a print operation speed of the rotary press and an actual print count of a print operation; and switching signal output means for providing the switching means with a switching signal indicative of switching the earlier operational plate cylinder and a switching signal indicative of switching the later operational plate cylinder. The print count management means is configured to compute a print count printed at the print operation speed by the plate cylinder in printing operation under the normal control during a preset time period to specially control the drive means for the later operational plate cylinder. The drive signal output means is configured to output the normal control signal indicative of executing the normal control for other plate cylinders than the later operational plate cylinder based on the print operation command, to output the special control signal indicative of executing the special control for the later operational plate cylinder when the actual print count checked at the print count management means reaches a value obtained by subscribing a sum of the computed value and a preset constant from a print count before change of operational plate cylinders set by the input console means, and to output the normal control signal indicative of executing the normal control for the later operational plate cylinder when the later operational plate cylinder has a rotational speed matched to that of the another plate cylinder normally controlled after the later operational plate cylinder is specially controlled for the preset time period. The drive signal output means is configured to provide the switching means with the switching signal when the later operational plate cylinder has a rotational phase matched to the reference rotational phase under the normal control and the actual print count checked by the print count management means reaches a print count before change of operational plate cylinders set by the input console means.

In accordance with the apparatus for changing operational plate cylinders during rotary press operation according to the present invention, an operational plate cylinder can be changed immediately after completion of printing for the set print count before change of the operational plate cylinders without halting print operation.

BRIEF DESCRIPTION OF THE DRAWINGS

The present invention will be more fully understood from the following detailed description with reference to the accompanying drawings in which.

DETAILED DESCRIPTION OF THE PREFERRED EMBODIMENTS

Figure 1:
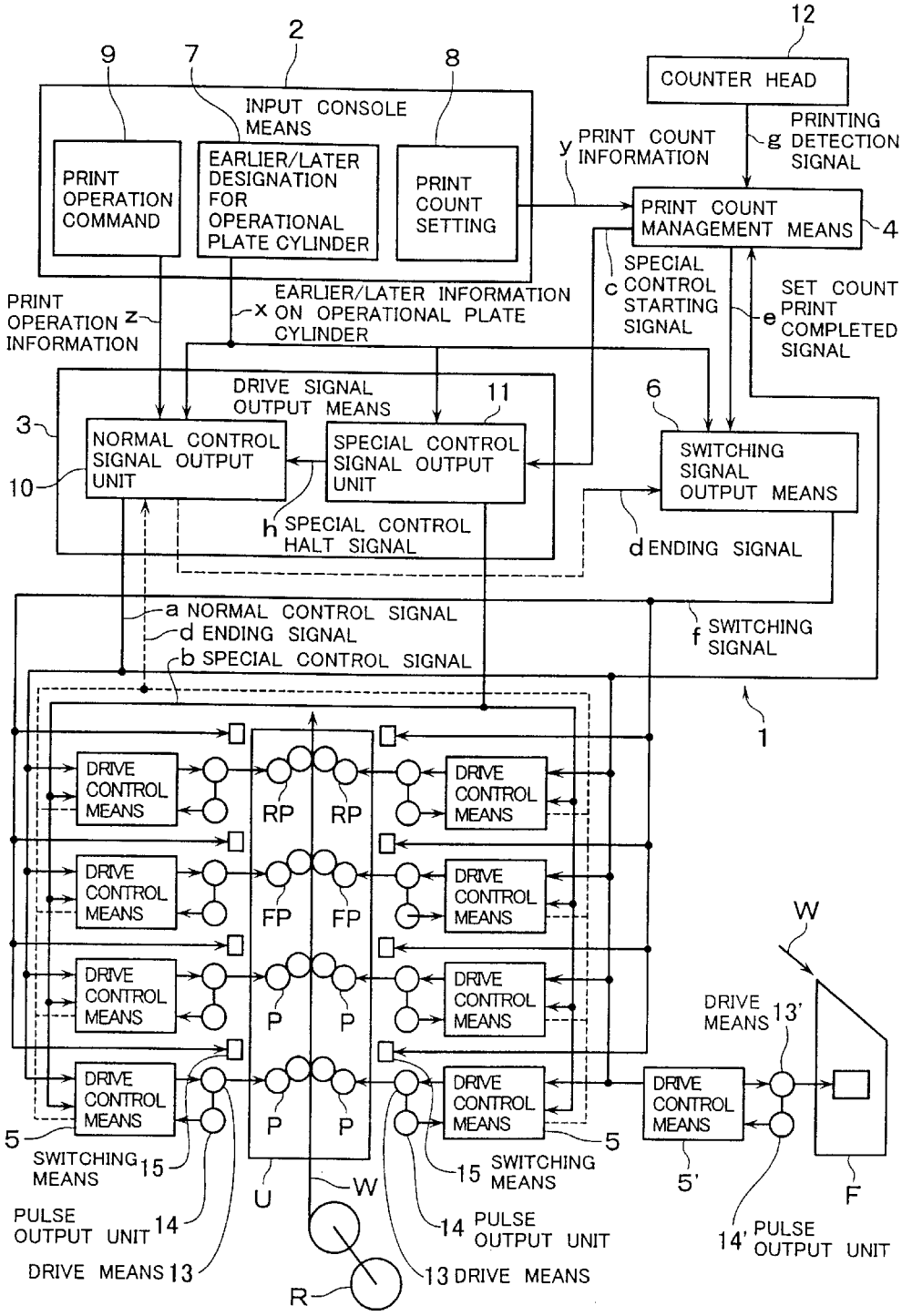
FIG. 1 is a schematic diagram showing an embodiment of a rotary press according to the present invention.
Figure 2:
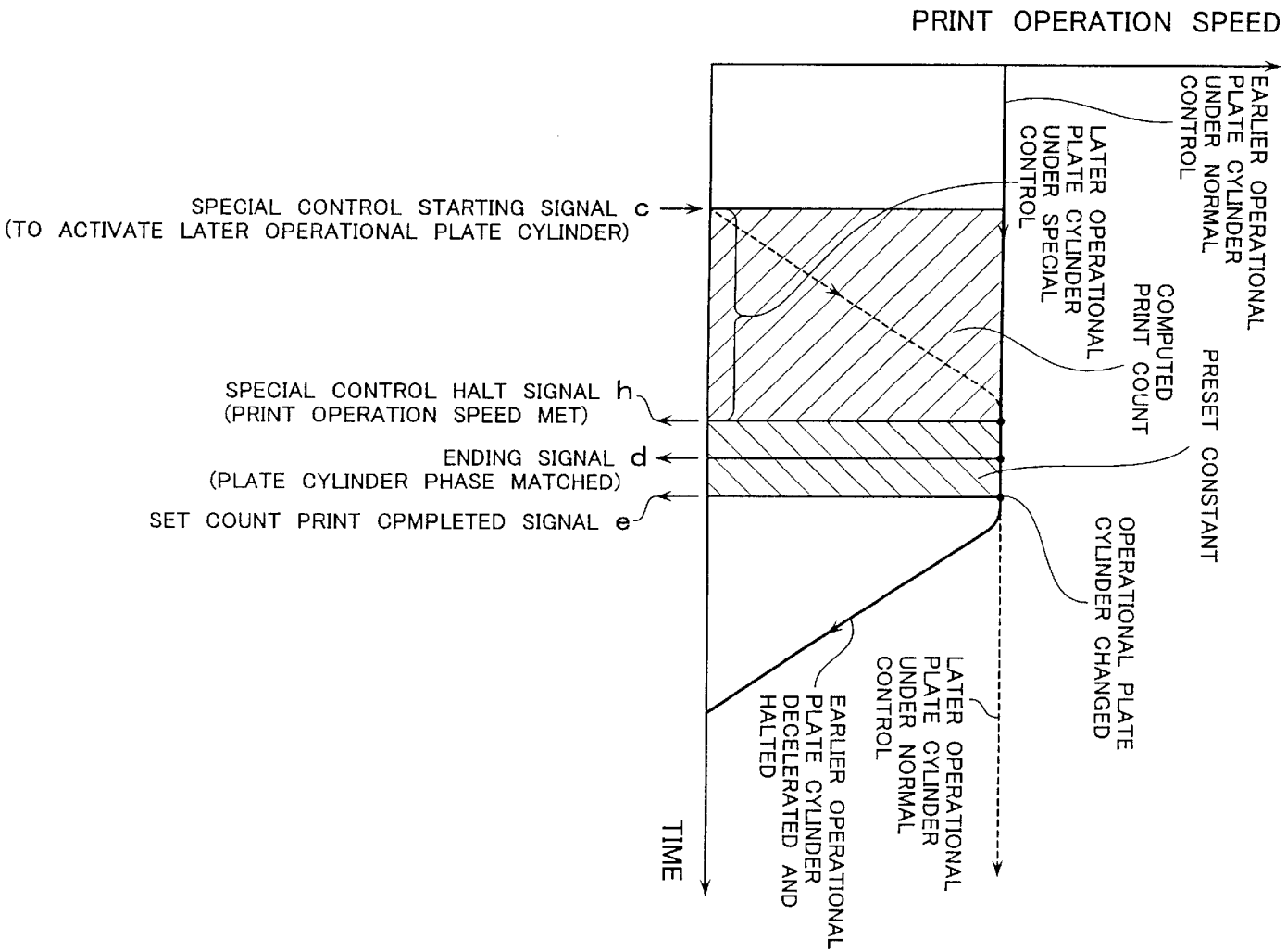
FIG. 2 is a timing chart showing print operations of the rotary press according to the present invention.

An embodiment will be described next on the basis of the drawings with respect to an apparatus for changing operational plate cylinders during rotary press operation according to the present invention. FIG. 1 is a schematic diagram showing a rotary press according to the present invention and FIG. 2 is a timing chart showing the print operation.

An apparatus for changing operational plate cylinders during rotary press operation, 1, in accordance with the present invention is employed in a rotary press shown in FIG. 1. The rotary press includes at least one paper feeder R for feeding a web paper W; at least one printing unit U provided with a plurality of plate cylinders P . . . ; a folding unit F for cutting and folding the web paper W after printed; and an input console means 2 capable of inputting designations, settings and commands associated with the rotary press operation. In addition the apparatus 1 includes a drive signal output means 3, a print count management means 4, drive control means 5 . . . , 5' and a switching signal output means 6. The drive signal output means 3 provides drive control means 5 . . . , 5', described later, with a normal control signal 'a' and a special control signal 'b', described later. The print count management means 4 always checks a print operation speed of the rotary press and an actual print count by a print operation. The print count management means 4 provides the drive signal output means 3 with a special control starting signal 'c', described later, and a switching signal output means 6, described later, with a set count print completed signal 'e'. The drive control means 5 . . . , 5' are arranged individually corresponding to the drive means 13 . . . for respectively driving each of the plate cylinders P . . . in the printing units U and to the drive means 13' for driving a rotator in the folding unit F to control the drive means 13 . . . , 13' in response to the control signal 'a' or 'b' output from the drive signal output means 3 and output signals, if required. Finally, the switching signal output means 6 provides switching means 15 . . . corresponding to the plate cylinders FP . . . , RP . . . , P . . . designated in accordance with the output signals from the print count management means 4 and the drive control means 5.

The shown embodiment is directed to the apparatus 1 for changing operational plate cylinders during rotary press operation applied in an offset printing press that has blanket cylinders respectively pairing with each of the plate cylinders P . . . , in which the plate cylinder P and the blanket cylinder are coupled to each other by a transmission means (not shown) and rotationally driven all at once by the drive means 13.

In FIG. 1, such plate cylinders that among the plate cylinders P . . . that are subjected to print operations previously are switched from a printable state to an unprintable state are referred to as earlier operational plate cylinders FP . . . and such plate cylinders that are switched from the unprintable state to the printable state are referred to as later operational plate cylinders RP . . . in the following description.

The input console means 2 can be employed to selectively input an earlier/later designation 7 for operational plate cylinders, a print count setting 8 and a print operation command 9, and may comprise a touch panel, for example. The earlier/later designation 7 is employed to designate the earlier operational plate cylinder FP and the later operational plate cylinder RP. The earlier/later designation 7 outputs the designated earlier operational plate cylinder FP and later operational plate cylinder RP as earlier/later information 'x' on operational plate cylinders. This information is provided to a normal control signal output unit 10 and a special control signal output unit 11 in the drive signal output means 3 as well as to the switching signal output means 6. The print count setting 8 is employed to set at least a print count before change of operational plate cylinders. The print count setting 8 provides the print count management means 4 with the set print count as print count information 'y'. The print operation command 9 is employed to designate print operations such as activation and halt of the rotary press and acceleration and deceleration of the print operation speed. It provides the normal control signal output unit 10 in the drive signal output means 3 with these print operations as print operation information 'z'.

The drive signal output means 3 includes the normal control signal output unit 10 and the special control signal output unit 11. They provide the drive control means 5, 5' with control signals for controlling rotations of the drive means 13 or 13' based on the designation, setting and command input from the input console means 2.

When an activation command or an acceleration command is input as the print operation information 'z' from the print operation command 9 in the input console means 2, the normal control signal output unit 10 outputs the normal control signal 'a'. This signal is provided to each of the drive control means 5, 5' arranged corresponding to respective drive means 13 . . . and 13' for driving the folding unit F and the plate cylinders P, FP that are not designated to later operational plate cylinders RP. When a special control halt signal 'h', described later, is input from the special control signal output unit 11, the normal control signal output unit 10 also outputs the current normal control signal 'a'. This signal is provided to the drive control means 5 that are arranged corresponding to the drive means 13 for driving the later operational plate cylinders RP. The normal control signal output unit 10 further outputs the normal control signal 'a' to the print count management means 4. Specifically, the normal control signal 'a' comprises a pulse signal that defines a rotational speed and phase of each of the drive means 13 . . . 13'.

Under the special control, described later, a rotational speed of the later operational plate cylinder RP meets with that of the earlier operational plate cylinder RP. In addition, a rotational phase of the later operational plate cylinder matches in a predetermined relation with that of the earlier operational plate cylinder RP based on the current normal control signal 'a'. Thereafter, the normal control signal output unit 10 receives an ending signal 'd' output from the drive control means 5 for controlling the drive means 13 for the later operational plate cylinder RP concerned. Then the normal control signal output unit 10 outputs the ending signal 'd' as such or a changed signal of the ending signal 'd' to the switching signal output means 6.

When the special control starting signal 'c', which is an activation signal for the later operational plate cylinder RP, is input from the print count management means 4, described later, the special control signal output unit 11 outputs the 'special control signal b'. This signal is provided to the drive control means 5 for controlling the drive means 13 for the later operational plate cylinder RP that is in a halt state as designated from the earlier/later designation 7. Specifically, the special control signal 'b' comprises a pulse signal that defines a rotational speed of the drive means 13 for the later operational plate cylinder RP. When a preset time period for specially controlling the later operational plate cylinder RP elapsed after the output of the special control signal 'b', the special control signal output unit 11 outputs the special control halt signal 'h' to the normal control output unit 10.

The print count management means 4 receives the print count before change of operational plate cylinders as the print count information 'y' set by the print count setting 8 in the input console means 2 as described above. The print count management means 4 is connected to a counter head 12 for detecting a printing and it always counts a value of the actual print count during printing operation based on a printing detection signal 'g' from the counter head 12. The print count management means 4 extracts a reference rotational speed of the drive means 13, 13' from the normal control signal 'a' input from the normal control signal output unit 10 in the drive signal output means 3 to detect a print operation speed.

During the preset time period for specially controlling the drive means 13 for the later operational plate cylinder RP, the print count management means 4 computes the print count printed at the current print operation speed by the earlier operational plate cylinder FP, which is subjected to printing operation under the normal control. And then the print count management means 4 outputs the special control starting signal 'c' when a value of the actual print count computed based on the printing detection signal 'g' reaches a certain value. This certain value is obtained by subtracting a sum of the computed value and a preset constant from the print count before change of operational plate cylinders set by the input console means 2. The special control starting signal 'c' or an activation signal for the later operational plate cylinder RP is provided to the special control signal output unit 11 in the drive signal output means 3. The "preset constant" is herein determined slightly larger than a print count to be printed when a printing operation is performed at the normal operation speed for a maximum time. This maximum time is required to match an actual rotational phase of the drive means 13 for driving the later operational plate cylinder RP in a predetermined relation with the reference rotational phase.

When the computed actual print count reaches the print count before change of operational plate cylinders, the print count management means 4 outputs the set count print completed signal 'e' to the switching signal output means 6.

Being connected to the drive signal output means 3; to the drive means 13 that is connected to the plate cylinder to drive it or the drive means 13' that is connected to the rotator of the folding unit F to drive it; and to the pulse output unit 14 or 14' that is connected to the drive means 13 or 13' to respond to the rotational speed and phase of the drive means 13 or 13', the drive control means 5, 5' drive control them.

On the basis of the normal control signal 'a' input from the normal control signal output unit 10, the drive control means 5, 5' normally control each of the drive means 13 . . . or 13' for driving the plate cylinders P, FP not designated to the later operational plate cylinder RP and the folding unit F. The drive control means 5, 5' also normally controls the drive means 13 for driving the later operational plate cylinder RP not under the special control, that is, the later operational plate cylinder RP that has a rotational speed matched to that of the earlier operational plate cylinder FP at the time of change of operational plate cylinders. In addition, on the basis of the special control signal 'b' input from the special control signal output unit 11, the drive control means 5, 5' specially control the drive means 13 for driving the later operational plate cylinder RP.

The normal control is designed to control the above-mentioned drive means 13 . . . or 13' in such a manner as to achieve a match to the reference rotational speed and phase extracted from the normal control signal 'a'. Namely, the actual rotational speeds and phases of the drive means 13, 13', fed back by the pulse signals from the pulse output units 14, 14' corresponding to the drive means 13 . . . or 13', are extracted at every predetermined timing and compared with the reference rotational speed and phase. Then, differences between both are corrected to control the rotation of each of the drive means 13, 13'.

The special control is designed to rotate the later operational plate cylinder RP in accordance with the special control signal 'b' and accelerate it to a rotational speed matched to the reference rotational speed within a certain preset time period. The reference rotational speed is based on the current normal control signal 'a' of the plate cylinders P, FP not designated to the later operational plate cylinder RP.

The drive control means 5, 5' outputs the ending signal 'd' to the normal control signal output unit 10 when the rotational speed and phase of the drive means 13 for driving the later operational plate cylinder RP under the normal control match to the reference rotational speed and phase extracted from the current normal control signal 'a'.

The switching signal output means 6 outputs the ending signal 'd' when an AND condition is established between the set count print completed signal 'e' output from the print count management means 4 and the ending signal 'd' output from the drive control means 5 corresponding to the later operational plate cylinder RP. This AND condition can be established, as shown in FIG. 2, when the later operational plate cylinder RP is specially controlled to have the same rotational speed as that of the earlier operational plate cylinder FP and then normally controlled to make a match in a predetermined relation with the rotational phase of the earlier operational plate cylinder FP. Thereafter, the switching signal output means 6 outputs the switching signal 'f' when the actual print count reaches the set print count before change of operational plate cylinders and the set count print completed signal 'e' is output. This switching signal 'f' is provided to the switching means 15 corresponding to the operational plate cylinder that is designated to the earlier operational plate cylinder FP by the earlier/later information 'x' and the switching means 15 corresponding to the operational plate cylinder that is designated to the later operational plate cylinder RP. As a result, each switching means 15 operates to perform change of operational plate cylinders for the designated plate cylinder so that the plate surface of the earlier operational plate cylinder FP separates from the blanket surface of the corresponding blanket cylinder. At the same time, the plate surface of the later operational plate cylinder RP contacts the corresponding blanket surface, which contacts the wed paper W.

Even when the set count print completed signal 'e' is output earlier and the ending signal 'd' later due to some reason not shown, the switching signal 'f' is also output as well. This switching signal 'f' is provided to the switching means 15 corresponding to the operational plate cylinder that is designated to the earlier operational plate cylinder FP by the earlier/later information 'x' and the switching means 15 corresponding to the operational plate cylinder that is designated to the later operational plate cylinder RP. As a result, each switching means 15 operates to perform change of operational plate cylinders for the designated plate cylinder so that the plate surface of the earlier operational plate cylinder FP separates from the blanket surface of the corresponding blanket cylinder. At the same time, the plate surface of the later operational plate cylinder RP contacts the blanket surface of the corresponding blanket cylinder, which contacts the wed paper W.

In accordance with the operation of the switching means 15, the blanket surface of the blanket cylinder corresponding to the earlier operational plate cylinder FP separates from the wed paper W.

The following description is directed to the operation of the apparatus 1 for changing operational plate cylinders during rotary press operation. As shown in FIG. 1, prior to the rotary press operation, appropriate operational conditions can be designated, set and commanded by the input console means 2.

Entering into details, the input console means 2 is first switched to a mode that allows the earlier/later designation 7 to input the earlier/later information 'x'. The earlier/later information 'x' input is output to and stored in the drive signal output means 3 and the switching signal output means 6. On the basis of this information, the drive control means 5, corresponding to the drive means 13 for driving the later operational plate cylinder RP designated, brings that drive means 13 into a halt state.

The input console means 2 is then switched to a mode that allows for the print count setting 8. This is employed to input at least the print count before change of operational plate cylinders or the print count information 'y' that is the print count by the earlier operational plate cylinder FP. The print count information 'y' input is output to and stored in the print count management means 4.

After completion of the above designation and setting, the input console means 2 is switched to a mode that allows the print operation command 9 to appropriately input the print operation information 'z' such as the activation, halt and acceleration and deceleration of the print operation speed.

When an activation command is input first as the print operation information 'z', the normal control signal output unit 10 in the drive signal output means 3 outputs the normal control signal 'a' that is a pulse signal for rotationally jogging the drive means 13, 13'. Subsequently, when an acceleration command is input as the print operation information 'z', the normal control signal output unit 10 outputs the normal control signal 'a' that is now changed to a pulse signal for rotating the drive means 13, 13' at a speed met with the command.

In the above situation, except for the drive control means 5 corresponding to the drive means 13 for driving the later operational plate cylinder RP, the drive control means 5 and 5' receive the normal control signal 'a' output from the normal control signal output unit 10 to extract the reference rotational speed and phase therefrom. They supply a power corresponding to the reference rotational speed to the drive means 13, 13' to rotate the drive means 13, 13' at the reference rotational speed. In addition, they take in the pulse signals output from the pulse output units 14 connected to the drive means 13, 13' to extract the actual rotational speeds and phases of the drive means 13, 13' therefrom. Finally, they compare the reference rotational phase with the actual rotational phases and the reference rotational speed with the actual rotational speeds and, to achieve respective matches in predetermined relations, control rotations of the drive means 13, 13'.

As descried above, on the basis of the normal control signal 'a', in the printing unit U of the rotary press, the plate cylinders P, FP not designated to the later operational plate cylinder RP and the folding unit F are controlled to activate and accelerate. When accelerated appropriately to the print operation speed, as shown in FIG. 2, they are subjected to a constant speed operation at that speed.

The actual print count of prints produced during the operation is always counted by the print count management means 4 based on the printing detection signal 'g' output from the counter head 12. To check the actual print count, it is then compared with the print count in the print count information 'y' input from the print count setting 8 before operation.

The web paper W printed in the printing operation is transported to the folding unit F for cutting it down to a certain long sheets and folding them into printed products.

The change of operational plate cylinders during print operation is described next.

As shown in FIGS. 1 and 2, the following manner is employed to generate a signal for promoting the change of operational plate cylinders or the special control starting signal 'c' that is an activation signal for the later operational plate cylinder RP. First, the special control is performed to the drive means 13 for the later operational plate cylinder RP. Namely, a time period is preset to allow the later operational plate cylinder RP in a halt state to become to have a rotational speed matched with that of the earlier operational plate cylinder FP. In addition, a print count at the current rotational speed of the earlier operational plate cylinder FP is computed by the print count management means 4 when a print operation is performed for the above preset time period. When an actual print count computed on the basis of the printing detection signal 'g' reaches a value, which is obtained by subtracting a sum of the computed value and a preset constant from the print count before change of operational plate cylinders set by the input console means 2, the print count management means 4 outputs the special control starting signal 'c' to the special control signal output unit 11 in the drive signal output means 3. The special control starting signal 'c' promotes the special control signal output unit 11 in the drive signal output means 3 to output the special control signal 'b' therefrom. It also brings the drive control means 5 corresponding to the drive means 13 for driving the later operational plate cylinder RP into a controllable state.

When the drive control means 5 corresponding to the drive means 13 for driving the later operational plate cylinder RP is brought into the controllable state and the special control signal 'b' is output from the special control signal output unit 11, that drive control means 5 controls and rotates the corresponding drive means 13 based on the special control signal 'b'. The special control signal 'b' is in the form of a pulse signal with a gradually increasing frequency that can gradually accelerate to rotate the drive means 13 for driving the later operational plate cylinder RP in order to match the rotational speed of the later operational plate cylinder RP with that of the earlier operational plate cylinder FP within a certain preset time period. The drive control means 5 extracts an actual rotational speed of the drive means 13 for driving the later operational plate cylinder RP from the output pulse out of the pulse output unit 14 corresponding to that drive means 13. In addition, it extracts the reference rotational speed from the special control signal 'b' and matches the actual rotational speed to the reference rotational speed while comparing both. The drive control means 5 does not control the rotational phase under control by the special control signal 'b'.

After the preset time period elapsed, the output of the special control signal 'b' is halted, and the special control signal output unit 11 outputs the special control halt signal 'h' to the normal control signal output unit 10. When the special control halt signal 'h' is input, the normal control signal output unit 10 outputs the current normal control signal 'a' to the drive control means 5 corresponding to the drive means 13 for driving the later operational plate cylinder RP. This drive control means 5 then starts to provide the corresponding drive means 13 with the same control as that in accordance with the above-mentioned normal control signal 'a'. At this moment, that drive means 13 has an actual rotational speed substantially equal to the reference rotational speed in the current normal control signal 'a'. In this situation, an actual rotational phase is controlled to match in a predetermined relation with the reference rotational phase in the current normal control signal 'a'. When the actual rotational phase matches to the reference rotational phase as described above, the drive control means 5 provides the normal control signal output unit 10 with the ending signal 'd' for indicating that the actual rotational phase matches in a predetermined relation with the reference rotational phase. The ending signal 'd' is fed to the switching signal output means 6 via the normal control signal output unit 10 in the drive signal output means 3.

The "preset constant", which is subtracted when the output timing of the special control starting signal 'c' is determined, is determined slightly larger than a print count to be printed when a printing operation is performed at the normal operation speed for a maximum time. This maximum time is required to match the actual rotational phase of the drive means 13 for driving the later operational plate cylinder RP in a predetermined relation with the reference rotational phase.

When the actual print count during print operation reaches the preset print count before change of operational plate cylinders, the print count management means 4 outputs the set count print completed signal 'e'. The output of the set count print completed signal 'e', though it is performed following the output of the ending signal 'd' because the "preset constant" is determined as above, may occur before the output of the ending signal 'd' due to some reason under control. The set count print completed signal 'e' is fed to the switching signal output unit 6.

When the ending signal 'd' and the set count print completed signal 'e' are input and an AND condition is satisfied between both signals, the switching signal output means 6 outputs the switching signal 'f'. This signal is provided to the switching means 15 corresponding to the earlier operational plate cylinder FP and the switching means 15 corresponding to the later operational plate cylinder RP designated by the earlier/later information 'x'.

According to the switching signal 'f', the switching means 15 operates to separate the plate surface of the earlier operational plate cylinder FP from the blanket surface of the blanket cylinder. It also separates the blanket surface from the running wed paper W, resulting in an unprintable state of the wed paper W. At almost the same time, the later operational plate cylinder RP contacts its plate surface with the blanket surface of the blanket cylinder. In addition, the blanket surface contacts the running wed paper W, resulting in a printable state of the wed paper W, followed by starting of print and terminating of change of operational plate cylinders.

As obvious from the forgoing, the earlier operational plate cylinder FP and the later operational plate cylinder RP are changed during rotary press operation and, actually, the print operation is continuously performed after changing print pages.

Designation of the earlier operational plate cylinder FP and the later operational plate cylinder RP may be performed to any plate cylinder in the printing unit U.

The earlier operational plate cylinder FP is decelerated and halted after the switching means 15 operates to separate the plate cylinder from the blanket surface of the blanket cylinder. When the earlier operational plate cylinder FP is halted, a timer (not shown) is activated by the switching signal 'f'. The timer generates a signal after a certain preset time elapsed. This timer signal may be employed to halt the operation of the drive control means 5 corresponding to the drive means 13 for driving the earlier operational plate cylinder FP and naturally stop the drive means 13. Alternatively, the timer signal may be employed to allow the special control signal output unit 11 to output a gradually decreasing pulse signal or the special control signal so as to halt the drive means 13 within a certain preset time. On the basis of the special control signal, the drive means 13 for driving the earlier operational plate cylinder FP may be decelerated and halted via the corresponding drive control means 5.

A blanket cylinder drive means (not shown) may be provided for rotationally driving the blanket cylinder independent of the drive means 13 for driving the plate cylinder. In addition, a blanket cylinder drive control means (not shown) may be provided for each blanket cylinder drive means. The normal control signal 'a' and special control signal 'b' from the drive signal output means 3 may be employed to control operation of each blanket cylinder drive means. In such the arrangement capable of individually driving the blanket cylinder and the plate cylinder, at the time of change of operational plate cylinders, it is possible to use the normal control signal 'a' to control the blanket cylinder drive means for the blanket cylinder that pairs with the earlier operational plate cylinder FP, while keeping the blanket surface of the blanket cylinder in contact with the running wed paper w. Therefore, it is also possible in this arrangement to change plate cylinders of course at both sides of the web paper W and to change a plate cylinder at one side.

As obvious from the forgoing, in accordance with the apparatus for changing operational plate cylinders during rotary press operation according to the present invention, it is possible to change an earlier operational plate cylinder and a later operational plate cylinder without halting print operation of the rotary press. In addition, it is possible to prevent undesired recording paper (paper loss) otherwise generated from change of operational plate cylinders. Thus, waste can be eliminated while keeping a high print operational rate. This is extremely effective to reduce running cost.

Having described the embodiments consistent with the invention, other embodiments and variations consistent with the invention will be apparent to those skilled in the art.

Therefore, the invention should not be viewed as limited to the disclosed embodiments but rather should be viewed as limited only by the spirit and scope of the appended claims.

What is claimed is:

1. An apparatus for changing operational plate cylinders during rotary press operation in a rotary press, said rotary press including at least two or more plate cylinders, drive means for driving said plate cylinders and switching means for selectively switching said plate cylinders in a printable state and in an unprintable state, said apparatus comprising;

input console means available for designating an earlier operational plate cylinder that is switched from the printable state to the unprintable state by said switching means and a later operational plate cylinder that is switched from the unprintable state to the printable state by said switching means among said two or more plate cylinders, setting at least a print count before change of operational plate cylinders, and inputting a print operation command to said rotary press;

drive control means for performing a normal control for controlling said drive means to rotate said plate cylinder with a match in terms of a reference rotational speed and phase, and performing a special control for controlling said drive means to accelerate said later operational plate cylinder in a halt state up to a rotational speed in coincident with the same rotational speed as that of another pink cylinder normally controlled;

drive signal output means for providing said drive control means with a normal control signal indicative of executing said normal control and a special control signal indicative of executing said special control;

print count management means for always checking a print operation speed of said rotary press and an actual print count of a print operation; and switching signal output means for providing said switching means with a switching signal indicative of switching said earlier operational plate cylinder and a switching signal indicative of switching said later operational plate cylinder, wherein said print count management means is configured to compute a print count printed at said print operation speed by said plate cylinder in printing operation under said normal control during a preset time period to specially control said drive means for said later operational plate cylinder;

said drive signal output means is configured to output said normal control signal indicative of executing said normal control for other plate cylinders than said later operational plate cylinder based on said print operation command, to output said special control signal indicative of executing said special control for said later operational plate cylinder when said actual print count checked at said print count management means reaches a value obtained by subscribing a sum of said computed value and a preset constant from said print count before change of operational plate cylinders set by said input console means, and to output said normal control signal indicative of executing said normal control for said later operational plate cylinder when said later operational plate cylinder has a rotational speed matched to that of said another plate cylinder normally controlled after said later operational plate cylinder is specially controlled for said preset time period; and said drive signal output means is configured to provide said switching means with said switching signal when said later operational plate cylinder has a rotational phase matched to said reference rotational phase under said normal control and said actual print count checked by said print count management means reaches said print count before change of operational plate cylinders set by said input console means.

2. An apparatus for changing operational plate cylinders during rotary press operation in a rotary press, said rotary press including plate cylinders, drive means for driving said plate cylinders and switching means for selectively switching said plate cylinders in a printable state and in an unprintable state, said apparatus comprising:

Input console means available for designating an earlier operational plate cylinder that is switched from the printable state to the unprintable state by said switching means and a later operational plate cylinder that is switched from the unprintable state to the printable state by said switching means among said plate cylinders, setting at least a print count before change of operational plate cylinders, and inputting a print operation command to said rotary press;

Print count management means for always checking a print operation speed of said rotary press and an actual print count of a print operation, wherein said print count management means is configured to compute a print count printed at said print operation speed by said plate cylinder in printing operation under a normal control indicative of controlling said drive means to rotate said plate cylinder with a match in terms of a reference rotational speed and phase during a preset time period to specially control said drive means for said later operational plate cylinder; and A drive signal output means is configured to output a normal control signal indicative of executing said normal control for other plate cylinders than said later operational plate cylinder based on said print operation command, to output a special control signal indicative of executing a special control indicative of controlling said drive means to accelerate said later operational plate cylinder in a halt state up to a rotational speed in coincident with the same rotational speed as that of another plate cylinder normally controlled for said later operational plate cylinder when said actual print count checked at said print count management means reaches a value obtained by subscribing a sum of said computed value and a preset constant from said print count before change of operational plate cylinders set by said input console means, and to output said normal control signal indicative of executing said normal control for said later operational plate cylinder when said later operational plate cylinder has a rotational speed matched to that of said another plate cylinder normally controlled after said later operational plate cylinder is specially controlled for said preset time period.

3. An apparatus as recited in claim 2, said apparatus further comprising drive control means for performing said normal control.

4. An apparatus as recited in claim 3, said drive control means configured to perform said special control.

5. An apparatus as recited in claim 4, wherein said drive signal output means for providing said drive control means with said normal control signal and said special control signal.

6. An apparatus as recited in claim 2, futher comprising switching signal output means for providing said switching means with a switching signal indicative of switching said earlier operational plate cylinder and a switching signal indicative or switching said later operational plate cylinder.

7. An apparatus as recited in claim 2, wherein said drive signal output means is configured to provide said switching means with said switching signal when said later operational plate cylinder has a rotational phase matched to said reference rotational phase under said normal control and said actual print count checked by said print count management means reaches said print count before change of operational plate cylinders set by said input console means.

8. An apparatus for changing operational plate cylinders during rotary press operation in a rotary press, said rotary press including plate cylinders, switching means for selectively switching said plate cylinders in a printable state and in an unprintable state, and drive means for driving said plate cylinders; said apparatus comprising:

Input console means available for designating an earlier operational plate cylinder that is switched from the printable state to the unprintable state by said switching means and a later operational plate cylinder that is switched from the unprintable state to the printable state by said switching means among said plate cylinders, setting at least a print count before change of operational plate cylinders, and inputting a print operation command to said rotary press;

Drive control means for performing a normal control for controlling said drive means to rotate said plate cylinders at the same rotational speed and phase; said drive control means configured to perform a special control for controlling said drive means to accelerate said later operational plate cylinder in a halt state up to a rotational speed in coincident with the same rotational speed as that of another plate cylinder normally controlled;

Print count management means for checking a print operation speed of said rotary press and an actual print count of a print operation, wherein said print count management means is configured to compute a print count printed at said print operation speed by said plate cylinder in printing operation under a normal control indicative of controlling said drive means to rotate said plate cylinder with a match in terms of a reference rotational speed and phase during a preset time period to specially control said drive means for said later operational plate cylinder; and Further comprising a drive signal output means is configured to output a normal control signal indicative of executing said normal control for other plate cylinders than said later operational plate cylinder based on said print operation command, to output a special control signal indicative of executing said special control for said later operational plate cylinder when said actual print count checked at said print count management means reaches a value obtained by subscribing a sum of said computed value and a preset constant from a print count before change of operational plate cylinders set by said input console means, and to output said normal control signal indicative of executing said normal control for said later operational plate cylinder when said later operational plate cylinder has a rotational speed matched to that of said another plate cylinder normally controlled after said later operational plate cylinder is specially controlled for said preset time period.

9. An apparatus as recited in claim 8, wherein said drive signal output means for providing said drive control means with said normal control signal and said special control signal.

10. An apparatus as recited in claim 14, wherein said drive signal output means is configured to provide said switching means with said switching signal when said later operational plate cylinder has a rotational phase matched to said reference rotational phase under said normal control and said actual print count checked by said print count management means reaches said print count before change of operational plate cylinders set by said input console means.

* * * * *

UNITED STATES PATENT AND TRADEMARK OFFICE

CERTIFICATE OF CORRECTION

PATENT NO. : 6,694,876 B2
DATED : February 24, 2004
INVENTOR(S) : Hideo Kawamori It is certified that error appears in the above-identified patent and that said Letters Patent is hereby corrected as shown below:

Column 14,
Line 29, "in claim 14" should read -- in claim 8 --

Signed and Sealed this

Eighteenth Day of May, 2004

JON W. DUDAS
*Acting Director of the United States Patent and Trademark Office*